United States Patent [19]

Oliver

[11] Patent Number: 4,631,742

[45] Date of Patent: Dec. 23, 1986

[54] ELECTRONIC CONTROL OF ROTATING ANODE MICROFOCUS X-RAY TUBES FOR ANODE LIFE EXTENSION

[75] Inventor: David W. Oliver, Schenectady, N.Y.

[73] Assignee: General Electric Company, Schenectady, N.Y.

[21] Appl. No.: 704,983

[22] Filed: Feb. 25, 1985

[51] Int. Cl.[4] ..... H05G 1/52

[52] U.S. Cl. ..... 378/113; 378/109; 378/110; 378/117; 378/118

[58] Field of Search ..... 378/109, 110, 113, 117, 378/118

[56] References Cited

U.S. PATENT DOCUMENTS

| | | | |
|---|---|---|---|
| 2,315,593 | 4/1943 | Cassen | 378/118 |
| 3,567,939 | 3/1971 | Schadler | 378/118 |
| 3,852,605 | 12/1974 | Watanabe et al. | 378/113 |
| 4,191,889 | 3/1980 | Cowell | 378/109 |
| 4,366,575 | 12/1982 | Bax | 378/110 |
| 4,490,834 | 12/1984 | Sudani | 378/110 |
| 4,594,554 | 6/1986 | Schick | 378/113 |

*Primary Examiner*—Craig E. Church
*Assistant Examiner*—John C. Freeman
*Attorney, Agent, or Firm*—Bernard J. Lacomis; James C. Davis, Jr.

[57] ABSTRACT

Anode life in an x-ray tube is extended by applying a reduced power density to the anode to afford controlled heating of the anode to a predetermined ductile temperature prior to operating the tube at full power. Controlled heating of the anode is accomplished by defocusing the electron beam for a period of time sufficient to enable the anode to reach the desired temperature. The electron beam source of the tube may also be controlled during heating of the anode so as to supply a reduced beam current.

12 Claims, 1 Drawing Figure

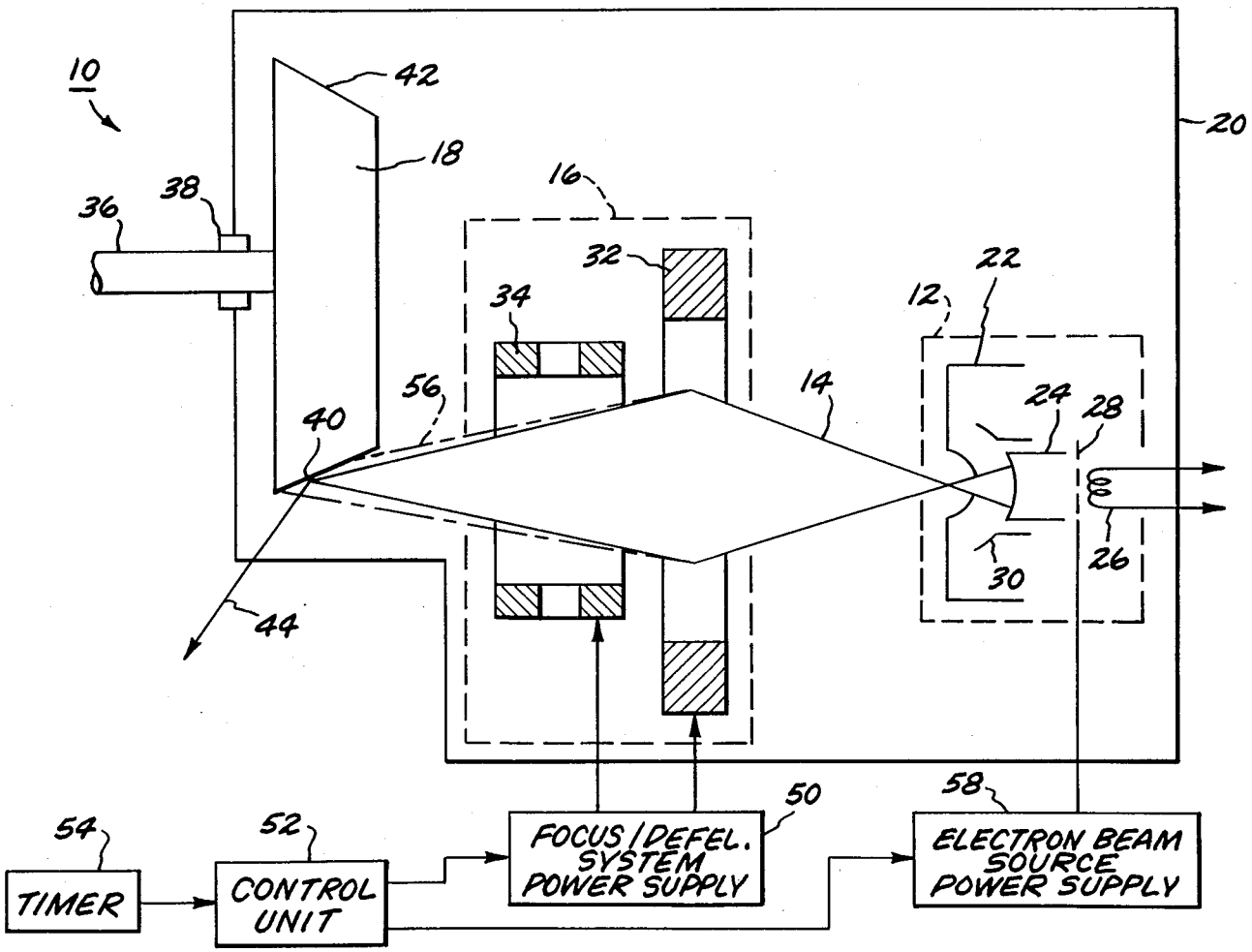
ELECTRON BEAM SOURCE POWER SUPPLY
FOCUS/DEFEL. SYSTEM POWER SUPPLY
CONTROL UNIT
TIMER
10
12
14
16
18
20
22
24
26
28
30
32
34
36
38
40
42
44
50
52
54
56
58

ELECTRONIC CONTROL OF ROTATING ANODE MICROFOCUS X-RAY TUBES FOR ANODE LIFE EXTENSION

BACKGROUND OF THE INVENTION

This invention relates generally to x-ray sources, and more particularly to the electronic control of rotating anode microfocus x-ray tubes to afford extended anode life.

X-ray radiography techniques such as computerized tomography (C.T.) and digital fluoroscopy (D.F.) may be used to advantage in many industrial applications, such as, for example, the non-destructive testing and inspection of parts. Such applications often require high intensity, high power x-ray sources capable of substantially continuous operation with very small focal spot sizes. For example, the inspection of parts formed of high atomic number materials, such as superalloy turbine blades for high performance aircraft engines, require x-ray sources capable of operating at voltages of the order of 400–500 kilovolts (kV) and high power levels of the order of tens to hundreds of kilowatts (kW) with focal spot sizes of the order of 1–10 mils. Since conventional fixed anode x-ray tubes have limited power dissipation capability, it is desirable to employ a rotating anode x-ray tube for such applications. Copending U.S. application Ser. No. 623,903, filed June 25, 1984, assigned to the assignee of the present invention, discloses a high intensity microfocus rotating anode x-ray tube that is particularly well adapted for such purposes.

A rotating anode x-ray tube typically comprises an evacuated enclosure housing an electron beam source, an electron beam deflection and focusing system, and an anode which is rotated at rather high speeds by means of a shaft which extends through a rotating seal in the wall of the enclosure. The rotating anode, which comprises an x-ray emissive material such as tungsten, is a relatively large and expensive element which is precisely machined and balanced. The electron beam is focused onto the rotating anode. As the electrons penetrate the anode, they give up their energy, causing heating of the anode, and emit x-rays. The large temperature gradients and temperature cycling to which the anode is subjected causes microfractures or cracks to develop in the anode early in its use cycle, and crack growth due to repeated thermal stresses ultimately makes the anode unusable, necessitating its replacement.

Thermal stresses are a significant contributing factor to fatigue and cracking of an x-ray tube anode. Because of the large temperature gradients and temperature cycling to which they are subjected, the anodes of high power x-ray tubes experience large thermal stresses which cause fatigue and short life. The thermal stresses are the greatest when the x-ray tube is first turned on. As the electrons penetrate the cold anode and give up their energy to produce x-rays, they produce highly localized and rapid heating of the anode under the electron beam spot and, accordingly, subject the anode to high temperature gradients. Tungsten, for example, which is a typical x-ray emissive anode material, is quite brittle and susceptible to cracking when its temperature is below a transition region temperature of the order of 1200° C., at which it becomes ductile.

Because the rotating anode is an expensive element, and its replacement is time consuming, it is desirable to extend the anode life as much as possible. This has led to the development of alloys having microstructures and properties which resist fatigue and extend anode life. Although such developments are useful for extending anode life, it is desirable to provide other ways of extending anode life which are simpler and more easily implemented, and it is to this end that the present invention is directed.

SUMMARY OF THE INVENTION

In accordance with the invention, the life of an x-ray tube anode is extended by minimizing the thermal stresses to which it is subjected. This is accomplished by controlling the x-ray tube upon it being turned on so as to afford controlled heating of the anode up to a predetermined temperature before the tube is operated at full power. During this preheating time, the electron beam power density applied to the anode is limited to a value less than the normal operating power level of the tube, and it is the electron beam which affords the controlled heating of the anode. During preheating, the electron beam is preferably defocused so that its energy is spread over a larger area on the anode, thereby reducing the power density applied to the anode and the thermal stresses to which the anode is subjected. The predetermined temperature to which the anode is preheated is preferably the temperature at which the anode material becomes ductile and is less susceptible to cracking, approximately 1200° C. for tungsten, for example. Upon the anode reaching the predetermined temperature, full power density is applied to the anode by refocusing the electron beam to its normal spot size. For a given anode and input power, the anode temperature will increase in a predictable manner as a function of time, and the predetermined anode temperature may be estimated by preheating with the defocused electron beam for a predetermined period of time.

Briefly stated, the invention affords a method and apparatus for extending the life of the anode of an x-ray tube by controlling the electron beam upon the tube being turned on so that a reduced electron beam power density which is less than the normal operating power density is applied to the anode. The reduced power density, which is selected to minimize thermal stresses in the anode, is maintained for a predetermined period of time sufficient to afford a controlled increase in anode temperature to a predetermined temperature at which the anode becomes ductile. Thereafter, the power density applied to the anode is increased to the normal operating level. More specifically, the power density applied to the anode can be controlled by controlling either the focusing of the electron beam onto the anode or the electron beam current emitted by the electron beam source, or both.

Other advantages and features of the invention will become apparent from the description which follows.

BRIEF DESCRIPTION OF THE DRAWING

The single figure is a diagrammatic view of a rotating anode x-ray tube which illustrates a preferred control arrangement in accordance with the invention for minimizing thermal stresses in the anode.

DESCRIPTION OF THE PREFERRED EMBODIMENTS

The invention is particularly well adapted for use with rotating anode x-ray tubes and will be described in that context. However, as will be appreciated from the description which follows, the invention is also applicable to fixed anode x-ray tubes.

The figure illustrates diagrammatically a rotating anode x-ray tube 10 employing a preferred control arrangement in accordance with the invention. Since the construction and operation of rotating anode tubes is generally well known to those skilled in the art, for simplicity the figure illustrates only the principal components of the tube.

As shown, the tube may comprise an electron beam source 12 for producing an electron beam 14, a focusing and deflection system 16 for focusing and deflecting the electron beam, and a generally frustro-conically shaped rotating anode 18, all disposed within an evacuated enclosure 20. The electron beam source 12 may be a Pierce-type electron gun of known form comprising a shaped anode 22, an indirectly heated shaped cathode 24 which is heated by a heater filament 26, a control grid 28, and a shaped electron shield 30. In the form illustrated, the focusing and deflection system 16 may comprise a focusing coil 32 and a deflection coil or yoke 34. Alternatively, the focusing and deflection system may employ conventional electrostatic focusing and deflection elements. Anode 18 may be supported on a rotatable shaft 36 which enters enclosure 20 through a conventional rotating seal 38. Shaft 36 is adapted to be connected to a rotating element (not illustrated) such as a motor for rotating the anode about the longitudinal axis of the shaft, and the anode may be cooled by a liquid coolant supplied thereto through the shaft. Tube 10 may be similar to that described in the aforereferenced copending application, and may be operated normally at approximately 450 kV and 80 kW with an electron beam focal spot size of the order of 1–10 mils. Anode 18 may have a radius of the order of 3 inches and a thickness of the order of 1 inch.

Rotating anode 18 comprises an x-ray emissive material, such as tungsten, for example. The focusing and deflection system 16 focuses the electron beam 14 to a fine spot 40 on the inclined surface 42 of the anode. As the electrons bombarding the surface of the anode penetrate the anode material, they give up their energy, causing corresponding heating of the anode under the electron beam spot, and produce a beam of x-rays 44 which exits the tube. The intensity or brightness of the emitted x-rays is related to the number of electrons per unit area impinging upon the anode, which in turn is related to the electron beam current produced by electron beam source 12 and the electron beam focal spot size on the anode. As the power incident upon the anode per unit area increases, so also does the temperature rise of the anode under the electron beam spot; and the magnitude of the temperature rise is a function, in part, of the thermal conductivity and the specific heat of the anode material. Since the anode cannot instantaneously diffuse the heat produced by the penetrating electrons giving up their energy, if full power is applied to the anode when it is cold, as when the tube is first turned on, the region under the electron beam spot will become very hot in relation to the bulk anode, and a large temperature differential, and hence large thermal stresses, will be produced. Because of the brittleness of conventional anode materials, such as tungsten, when they are cold, the large thermal stresses may produce cracking of the anode and significantly shorten its life.

In accordance with the invention, thermal stresses in the anode are minimized by first preheating the anode in a controlled manner to a predetermined temperature at which the anode material becomes ductile (approximately 1200° C. for tungsten, for example) prior to applying the normal operating electron beam power density to the anode. Preheating is accomplished using the electron beam by operating the tube at a reduced power density level for a sufficient period of time to enable the anode temperature to reach the predetermined ductile temperature. The manner in which this is accomplished will now be described.

As previously indicated, during normal operation the focusing and deflection system 16 of the tube focuses electron beam 14 onto the anode at a predetermined location and with a predetermined spot size, for example, 1–10 mils in diameter. Focusing coil 32 and deflection coil 34 of the focusing and deflection system may be supplied with appropriate voltages (or currents) for this purpose from a focus and deflection system power supply 50. In accordance with the invention, power supply 50 may be controlled, as by a control unit 52 and a timer 54, such that when the tube is first turned on the electron beam is defocused, as shown in phantom lines 56, so that the electron beam spot size on the anode is greater than the normal operating spot size. For example, if the normal operating spot size is of the order of 1–10 mils, the electron beam may be defocused to a line or a circle having a size of the order of 0.25–0.5 inch, i.e., by a factor of the order of 25–500 times. This effectively reduces the power density impinging upon the anode and enables the anode temperature to increase gradually and in a controlled manner to the desired predetermined temperature at which the anode material becomes ductile. Accordingly, the thermal gradients and thermal stresses experienced by the anode are minimized.

The electron beam may be maintained in the defocused condition for a predetermined period of time, as established by timer 54, which is sufficient to enable the temperature of the anode to reach the desired predetermined temperature. For a given anode size and a given incident power density, the time required for the anode to reach the predetermined temperature depends upon the specific heat and the thermal diffusion characteristics of the anode material, and this time may be determined readily in a well known manner. The time can be estimated from the time required for heat to diffuse approximately one centimeter, or the time required to heat a 100 $cm_3$ volume to 1200° C. For tungsten, this diffusion time is about two seconds, and the heating time for an 80 kW source is of the order of 4.5 seconds. Hence, an appropriate preheating time to minimize fatigue and thermal stress is of the order of a few minutes. In general, anode preheat times may be in the range of a few seconds to 5–10 minutes.

Power supply 50 may be a generally conventional power supply which is designed to apply two different voltages (or currents), i.e., a defocusing voltage and a focusing voltage, to the focusing and deflection system 16 in response to a signal from control unit 52. The control unit and timer, which may be implemented in a number of different ways known to those skilled in the art, may simply comprise a relay driven by an electrical or mechanical timer, for example, for causing the power supply to generate the two different voltages or currents. If desired, the timer may be included within the control unit, and the control unit may simply be incorporated within the power supply.

Control unit 52 may also control the electron beam current produced by source 12 so as to cause the source to generate a reduced beam current during preheating. This may be accomplished, for example, by controlling a beam current power supply 58 which supplies a control voltage to control grid 28 of source 12. Alternatively, the control unit may be employed for controlling focusing elements of the electron beam source, such as by controlling the voltage of anode 22 or the voltage of cathode 24. As with power supply system 50, the control unit may cause the electron source to simply generate two different beam currents, i.e., a reduced beam current during preheating of the anode and a normal beam current during normal operation of the tube. If desired, the control unit may also provide for a continuous gradual increase in beam current or refocusing of the electron beam with time as the anode temperature increases to expedite preheating.

As may be appreciated from the foregoing, the invention provides a rather simple easily implemented system for reducing the incident power density on the anode so as to provide controlled heating of the anode to a predetermined temperature, thereby reducing fatigue and thermal stresses in the anode and affording an increase in anode life.

While preferred embodiments of the invention have been shown and described, it will be appreciated by those skilled in the art that changes may be made in these embodiments without departing from the principles and spirit of the invention, the scope of which is defined in the appended claims.

What I claim as new and desire to secure by Letters Patent of the United States is:

1. A method of extending the life of an anode of an x-ray tube of the type in which an electron bean from an electron beam source is focused onto the anode to produce x-rays, the method comprising the steps of:

defocusing the electron beam upon turn-on of the tube to apply a reduced electron beam power density to the anode, the reduced power density having a value selected to be less than a normal operating electron beam power density and to minimize thermal stresses in the anode;

maintaining said reduced power density for a predetermined period of time sufficient to afford a controlled increase in anode temperature to a predetermined temperature at which the anode is ductile; and focusing the electron beam after said predetermined period of time to increase the power density applied to the anode to said normal operating power density.

2. The method of claim 1, wherein said defocusing comprises defocusing the electron beam to produce a spot size of the order of 25–500 times greater than the normal spot size.

3. The method of claim 1, wherein said defocusing comprises applying a first voltage to a focusing element of the tube to defocus the electron beam, and said focusing comprises applying a second voltage to said focusing element to focus the electron beam.

4. The method of claim 1 and further including the step of controlling the electron beam source upon turn-on of the tube to limit the electron beam current density to a value less than a normal operating electron beam current density for said predetermined period of time.

5. The method of claim 1, wherein said predetermined period of time is selected in accordance with the electron beam power applied to the anode and the anode thermal characteristics.

6. Apparatus for extending the life of an anode of an x-ray tube of the type which includes an electron beam source, an anode, and means for focusing an electron beam produced by the source onto the anode to produce x-rays, the apparatus comprising:

means operative upon turn-on of the tube for defocusing the electron beam to apply a reduced electron beam power density to the anode, the reduced power density having a value selected to be less than a normal operating electron beam power density and to minimize thermal stresses in the anode;

means for maintaining the electron beam power density applied to the anode at said reduced power density value for a predetermined period of time sufficient to afford a controlled increase in anode temperature to a predetermined temperature at which the anode is ductile; and means for focusing the electron beam after said predetermined period of time to increase the power density applied to the anode to said normal operating power density.

7. The apparatus of claim 8, wherein said defocusing means defocuses the electron beam by a factor of the order of 25–500.

8. The apparatus of claim 6, wherein said defocusing means and said refocusing means comprises means for applying first and second voltages to the electron beam focusing means for defocusing and refocusing the electron beam, respectively.

9. The apparatus of claim 8, wherein said defocusing means and refocusing means comprises a control unit for controlling a power supply of the tube which applies voltages to the focusing means, and said maintaining means comprises timer means for controlling said control unit so as to defocus the electron beam for said predetermined period of time.

10. The apparatus of claim 6 and further including means for controlling the electron beam source upon turn-on of the tube to limit the electron beam current density to a value less than a normal operating electron beam current density for said predetermined period of time.

11. The apparatus of claim 6, wherein said tube comprises a rotating anode microfocus x-ray tube having a normal operating power of the order of 80 kW and a normal spot size of the order of 1–10 mils.

12. The apparatus of claim 9, wherein said predetermined period of time is in the range of a few seconds to a few minutes.

* * * * *